US008192048B2

(12) United States Patent
Kristoffersen et al.

(10) Patent No.: US 8,192,048 B2
(45) Date of Patent: Jun. 5, 2012

(54) LIGHTING ASSEMBLIES AND SYSTEMS

(75) Inventors: Martin Kristoffersen, Maplewood, MN (US); Rolf W. Biernath, Wyoming, MN (US); Thomas R. Corrigan, Saint Paul, MN (US); David G. Freier, Saint Paul, MN (US); Raymond P. Johnston, Lake Elmo, MN (US); Michael A. Meis, Stillwater, MN (US); Kenneth A. P. Meyer, Shoreview, MN (US); Vadim N. Savvateev, Saint Paul, MN (US); William A. Tolbert, Woodbury, MN (US); Phillip E. Tuma, Faribault, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 335 days.

(21) Appl. No.: 12/620,946

(22) Filed: Nov. 18, 2009

(65) Prior Publication Data

US 2010/0271819 A1 Oct. 28, 2010

Related U.S. Application Data

(60) Provisional application No. 61/171,655, filed on Apr. 22, 2009.

(51) Int. Cl.
*F21V 1/00* (2006.01)

(52) U.S. Cl. ..... 362/235; 362/249.02; 362/294; 362/373

(58) Field of Classification Search ..... 362/267, 362/294, 235, 238, 373, 249.01, 249.02; 361/704, 709, 711; 165/80.3
See application file for complete search history.

(56) References Cited

U.S. PATENT DOCUMENTS

D207,551 S 5/1967 Spaulding
5,998,925 A 12/1999 Shimizu et al.
6,452,217 B1 9/2002 Wojnarowski et al.
6,974,229 B2 12/2005 West et al.
7,027,304 B2 * 4/2006 Aisenbrey ..... 361/704
7,285,802 B2 10/2007 Ouderkirk et al.
7,296,916 B2 11/2007 Ouderkirk et al.
D564,691 S 3/2008 Ertze Encinas et al.
7,369,410 B2 * 5/2008 Chen et al. ..... 361/701
7,402,831 B2 7/2008 Miller et al.
D584,223 S 1/2009 Cooper
D595,645 S 7/2009 Beghelli
D609,837 S 2/2010 Zheng
7,654,686 B2 * 2/2010 Oza ..... 362/231
D621,986 S 8/2010 Yan
D621,987 S 8/2010 Tsai et al.
D622,432 S 8/2010 Yan
(Continued)

*Primary Examiner* — John A Ward

(57) ABSTRACT

The present disclosure relates to illumination or lighting assemblies and systems that provide illumination using LEDs. In one aspect, the present disclosure provides a lighting assembly, comprising: multiple light emitting diodes that emit light; an optical system that directs the light emitted by the light emitting diodes, the optical system positioned adjacent to light emitting diodes; and a cooling fin including a two-phase cooling system, the cooling fin positioned adjacent to the light emitting diodes such that the two-phase cooling system removes heat from the light emitting diodes. In another aspect, the present disclosure provides a lighting system including multiple lighting assemblies. The lighting assemblies and systems of the present disclosure can be used in, for example, a street light, a backlight (including, for example, a sun-coupled backlight), a wall wash light, a billboard light, a parking ramp light, a high bay light, a parking lot light, a signage lit sign (also referred to as an electric sign), static signage (including, for example, sun-coupled static signage), illuminated signage, and other lighting applications.

22 Claims, 11 Drawing Sheets

U.S. PATENT DOCUMENTS

| | | | | |
|---|---|---|---|---|
| D622,886 | S | 8/2010 | Zheng et al. | |
| 7,806,577 | B2 | 10/2010 | Van As et al. | |
| 7,819,556 | B2 * | 10/2010 | Heffington et al. | 362/294 |
| D631,004 | S | 1/2011 | Johnson | |
| 8,070,306 | B2 * | 12/2011 | Ruud et al. | 362/101 |
| 2006/0124918 | A1 | 6/2006 | Miller et al. | |
| 2006/0124938 | A1 | 6/2006 | Miller et al. | |
| 2007/0091622 | A1 | 4/2007 | Huang et al. | |
| 2007/0216274 | A1 | 9/2007 | Schultz et al. | |
| 2007/0258213 | A1 * | 11/2007 | Chen et al. | 361/701 |
| 2008/0174963 | A1 * | 7/2008 | Chang et al. | 361/700 |
| 2008/0219007 | A1 | 9/2008 | Heffington et al. | |
| 2009/0001608 | A1 | 1/2009 | Mii et al. | |
| 2009/0262533 | A1 | 10/2009 | Liu et al. | |
| 2010/0038660 | A1 | 2/2010 | Shuja | |

* cited by examiner

LIGHTING ASSEMBLIES AND SYSTEMS

REFERENCE TO RELATED APPLICATION

The present application claims priority to U.S. Provisional Patent Application Ser. No. 61/171,655 and filed Apr. 22, 2009, which is incorporated herein by reference as if fully set forth.

TECHNICAL FIELD

The present disclosure generally relates to a lighting or illumination assembly. More particularly, the present disclosure relates to a lighting or illumination assembly that uses light emitting diodes (LEDs).

BACKGROUND

Illumination assemblies are used in a variety of diverse applications. Traditional illumination assemblies have used lighting sources such as incandescent or fluorescent lights. More recently, other types of light emitting elements, and light emitting diodes (LEDs) in particular, have been used in illumination assemblies. LEDs have the advantages of small size, long life, and energy efficiency. These advantages of LEDs make them useful in many diverse applications.

For many lighting applications, it is desirable to have one or more LEDs supply the required luminous flux and/or illuminance. LEDs in an array are commonly connected to each other and to other electrical systems by mounting the LEDs onto a substrate. LEDs may be populated onto a substrate using techniques that are common to other areas of electronics manufacturing, e.g., locating components onto circuit board traces, followed by bonding the components to the substrate using one of a number of known technologies, including hand soldering, wave soldering, reflow soldering, and attachment using conductive adhesives.

In addition to light, LEDs generate heat during operation. The amount of heat and light generated by an LED is generally proportional to the current flow. Consequently, the more light an LED generates, the more heat the LED generates. Unfortunately, as LED current increases and temperature increases, less light is produced proportional to current, causing LED efficiency and lifetime to decrease.

One prior art attempt to reduce the total heat in a lighting system is shown schematically in FIG. 1. The lighting system 1 of FIG. 1 includes multiple LEDs 2 affixed to a substrate 3. Multiple solid fins 4 are vertically attached to substrate 3. Heat generated by each LED 2 is diffused to substrate 3 and further into solid fins 4. Air flow around solid fins 4 causes convective cooling of solid fins 4.

Another prior art attempt to reduce the total heat in a lighting system is shown schematically in FIG. 2. The lighting system 5 of FIG. 2 is the same as lighting system 1 of FIG. 1 except that multiple heat pipes 6 are embedded in or attached to substrate 3 such that substrate 3 effectively becomes a heat spreader. A heat pipe is a heat transfer device that can transport large quantities of heat with a very small difference in temperature between hotter and colder interfaces. Heat pipes employ evaporative cooling to transfer thermal energy from one point to another by the evaporation and condensation of a working fluid or coolant.

Planar heat pipe (or heat spreader) 6 as shown in FIG. 2 includes a hermetically sealed hollow vessel containing a working fluid (not shown) and a closed-loop capillary recirculation system (not shown). Inside the walls of heat pipe 6, at the hotter interface(s), the working fluid turns to vapor, which naturally flows and condenses on the colder interface(s). The liquid falls or is moved by capillary action back to the hot interface to evaporate again and repeat the cycle. One practical limit to the rate of heat transfer is the speed with which the gas can be condensed to a liquid at the cold end. When one end of the heat pipe is heated, the working fluid inside the pipe at that end evaporates and increases the vapor pressure inside the cavity of the heat pipe. The latent heat of evaporation absorbed by the vaporization of the working fluid reduces the temperature at the hot end of the pipe. The vapor pressure over the hot liquid working fluid at the hot end of the pipe is higher than the equilibrium vapor pressure over condensing working fluid at the cooler end of the pipe, and this pressure difference drives a rapid mass transfer to the condensing end where the excess vapor condenses, releases its latent heat, and warms the cool end of the pipe. In this way, heat from LEDs 2 is dissipated throughout lighting system 5.

Another prior art attempt to reduce the total heat in a lighting system is shown schematically in FIG. 3. The lighting system 7 of FIG. 3 includes multiple LEDs 2 attached to the underside of substrate 3. Two heat pipes 6 are attached to substrate 3 and curve upward. Multiple solid fins 4 are attached to each heat pipe 6. Heat generated by LEDs 2 diffuses to substrate 3, then to heat pipes 6, and then to fins 4 which rely on convective cooling.

SUMMARY

The inventors of the present application recognized that if a desired low LED temperature can be maintained, the LED can be operated at higher brightness (increased current). Increased brightness of each LED in a lighting system can also facilitate the use of fewer LEDs, resulting in a lower cost lighting system. Consequently, the inventors of the present application recognized that maintaining a desired low LED temperature produces more LED light, saves electricity, and lengthens the life of the LED.

The inventors of the present application discovered energy efficient lighting and illumination assemblies. Specifically, in the lighting system(s) and/or assemblies of the present application, heat is dissipated more efficiently from the heat source than in existing designs, resulting in improvements in, for example, electrical efficacy, lifespan, manufacturing costs, weight, and size.

The present disclosure relates to illumination or lighting assemblies and systems that provide illumination using LEDs. The illumination or lighting systems of the present application include high brightness, high intensity systems with controlled light distribution. The illumination assemblies and systems disclosed herein may be used for general lighting purposes, e.g., to illuminate an area or to generate light output appropriate for injection into many different lighting applications. Such assemblies are suitable for use in, for example, a street light, a backlight (including, for example, a sun-coupled backlight), a wall wash light, a billboard light, a parking ramp light, a high bay light, a parking lot light, a signage lit sign (also referred to as an electric sign), static signage (including, for example, sun-coupled static signage), illuminated signage, and other lighting applications.

In one aspect, the present disclosure provides a lighting assembly, comprising: one or more light emitting diodes that emit light; an optical system that directs the light emitted by the light emitting diodes, the optical system positioned adjacent to light emitting diodes; and a cooling fin including a two-phase cooling system, the cooling fin positioned adjacent to the light emitting diodes such that the two-phase cooling system removes heat from the light emitting diodes.

In another aspect, the present disclosure provides a lighting system including multiple lighting assemblies.

In another aspect, the present disclosure provides a street light, comprising: multiple light emitting diodes that emit light; an optical system that directs the light emitted by the light emitting diodes, the optical system positioned adjacent to the light emitting diodes; and multiple cooling fins each of which includes a two-phase cooling system, the multiple cooling fins positioned adjacent to the light emitting diodes such that the two-phase cooling systems within the cooling fins remove heat from the light emitting diodes.

In another aspect, the present disclosure provides a wall wash, comprising: a light emitting diode that emits light; an optical system that directs the light emitted by the light emitting diode; and a two-phase cooling system including a convective cooling surface, the two-phase cooling system positioned adjacent to the light emitting diode such that the two-phase cooling system diffuses heat away from the light emitting diode.

In another aspect, the present disclosure provides a lighting system, comprising: a light emitting diode that emits light; an optical system that directs the light emitted by the light emitting diode; and a two-phase cooling system including a convective cooling surface and the two-phase cooling system positioned adjacent to the light emitting diode such that the two-phase cooling system diffuses heat away from the light emitting diode.

BRIEF DESCRIPTION OF DRAWINGS

One prior art attempt to reduce the total heat in a lighting system is shown schematically in FIG. 1.

Another prior art attempt to reduce the total heat in a lighting system is shown schematically in FIG. 2.

Figure 1:
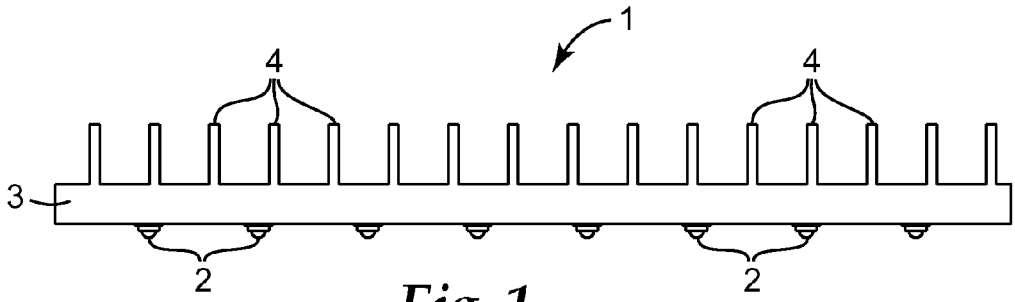
Fig. 1 Prior Art
Figure 2:
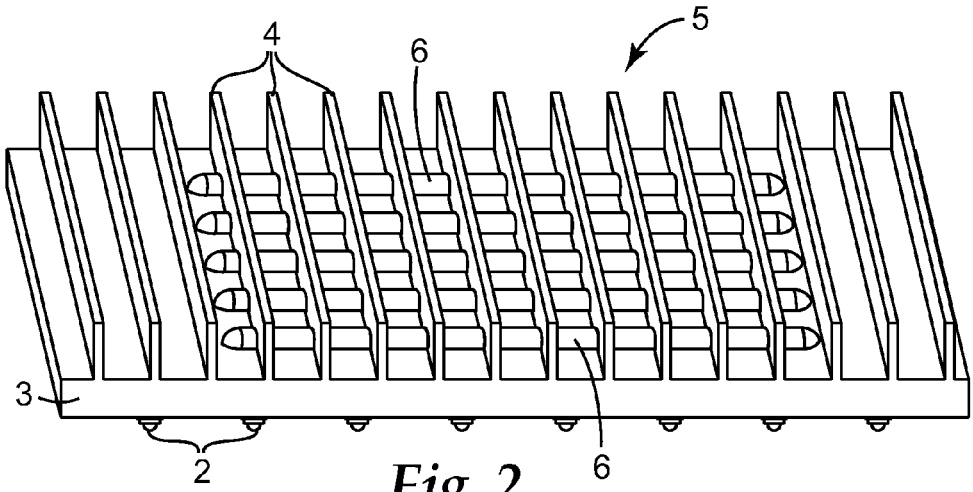
Fig. 2 Prior Art
Figure 3:
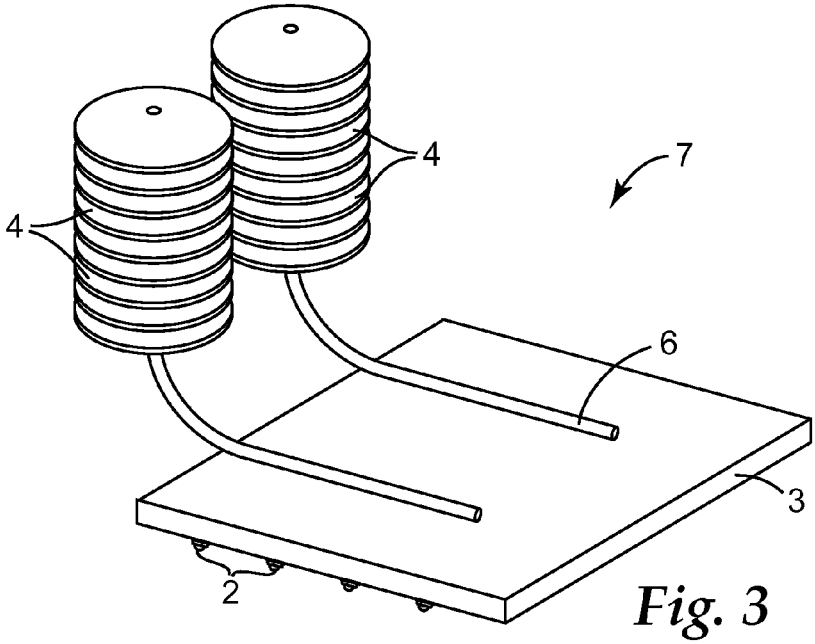
Fig. 3 Prior Art

Another prior art attempt to reduce the total heat in a lighting system is shown schematically in FIG. 3.

Figure 4A:
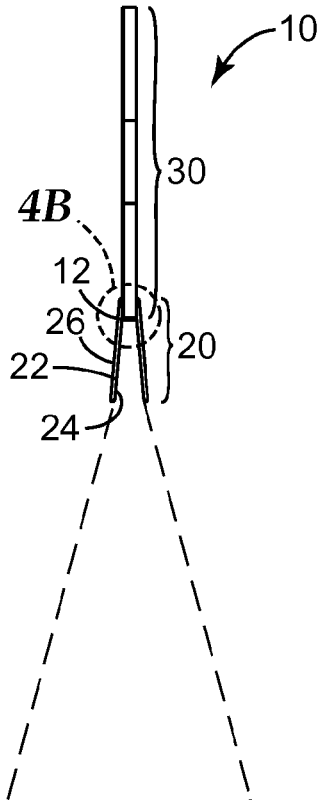
Figure 4B:
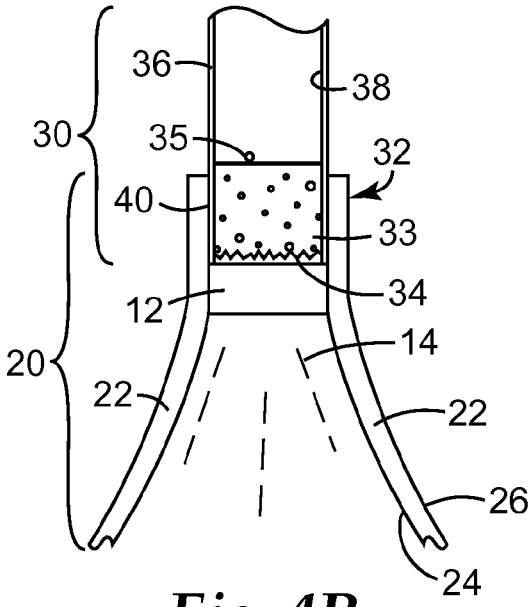

FIGS. 4A and 4B are cross-sectional schematic drawings of a lighting assembly including an LED that emits light.

Figure 5:
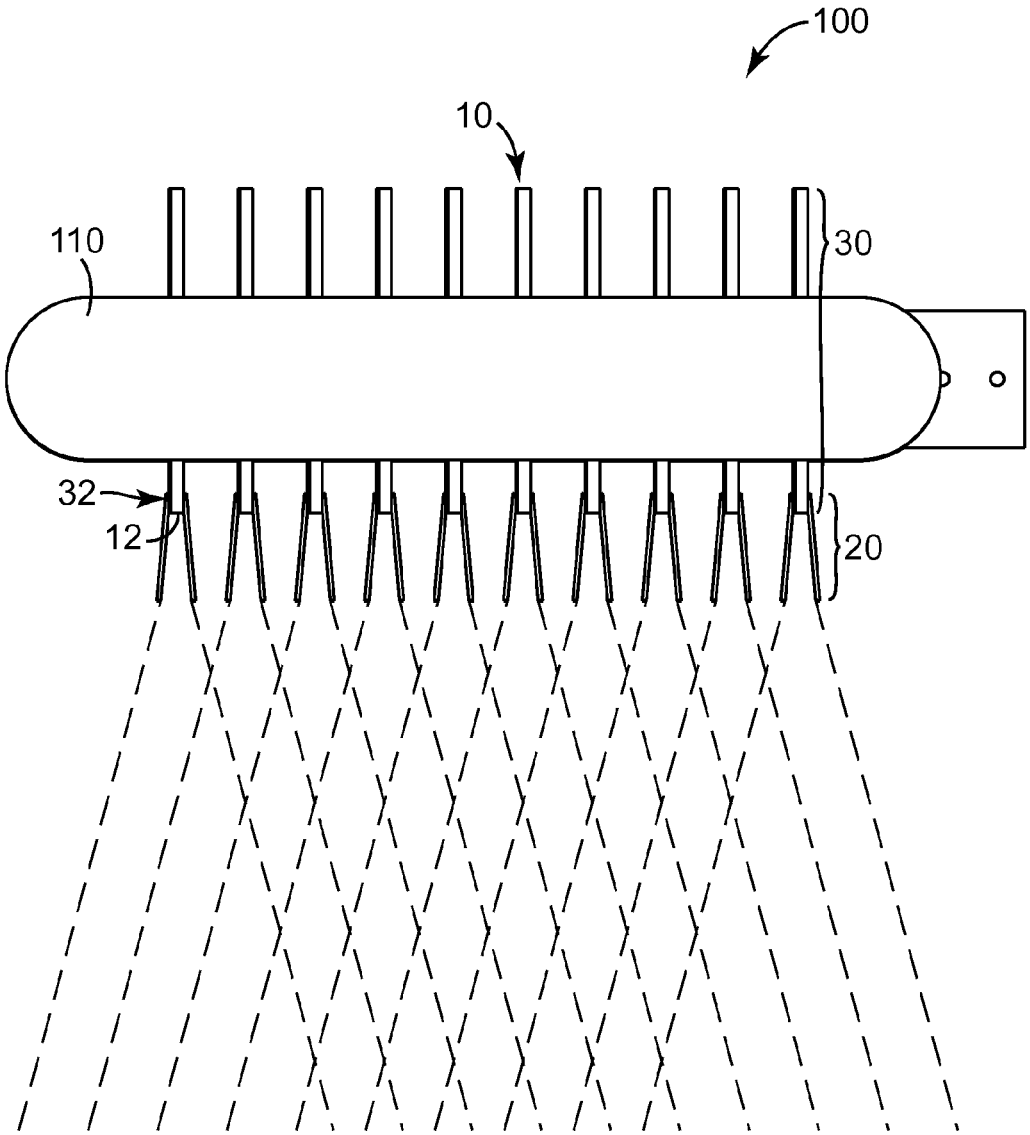

FIG. 5 is a side view of a lighting system including multiple individual lighting assemblies.

Figure 6:
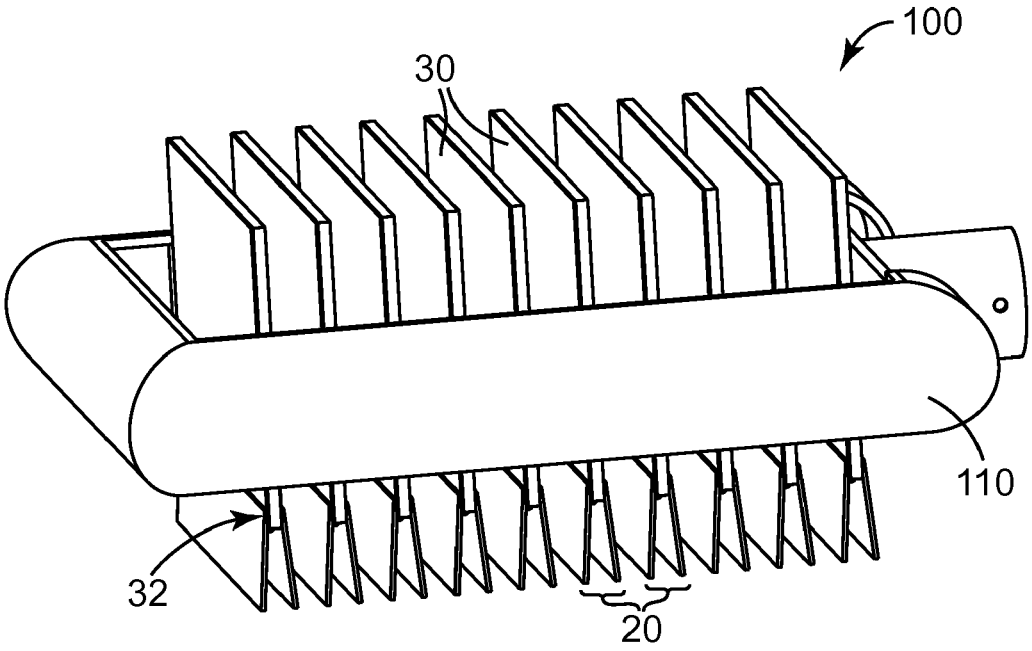

FIG. 6 is a perspective view of a lighting system that includes multiple individual lighting assemblies.

Figure 7A:
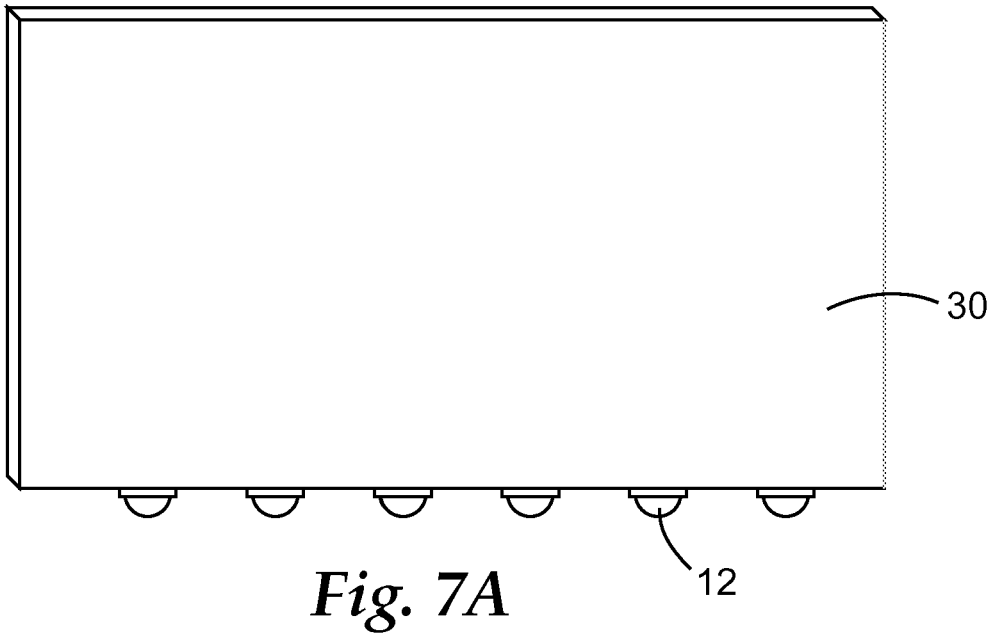
Figure 7B:
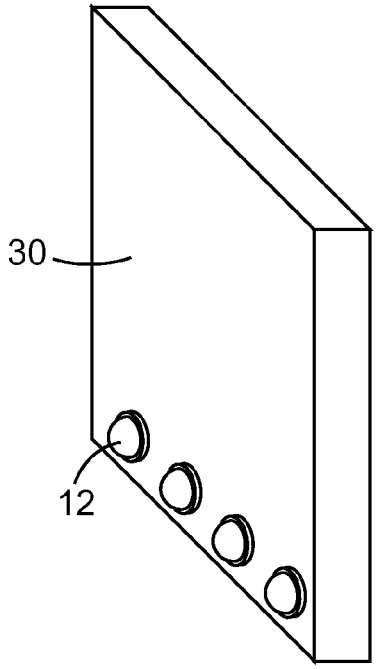
Figure 7C:
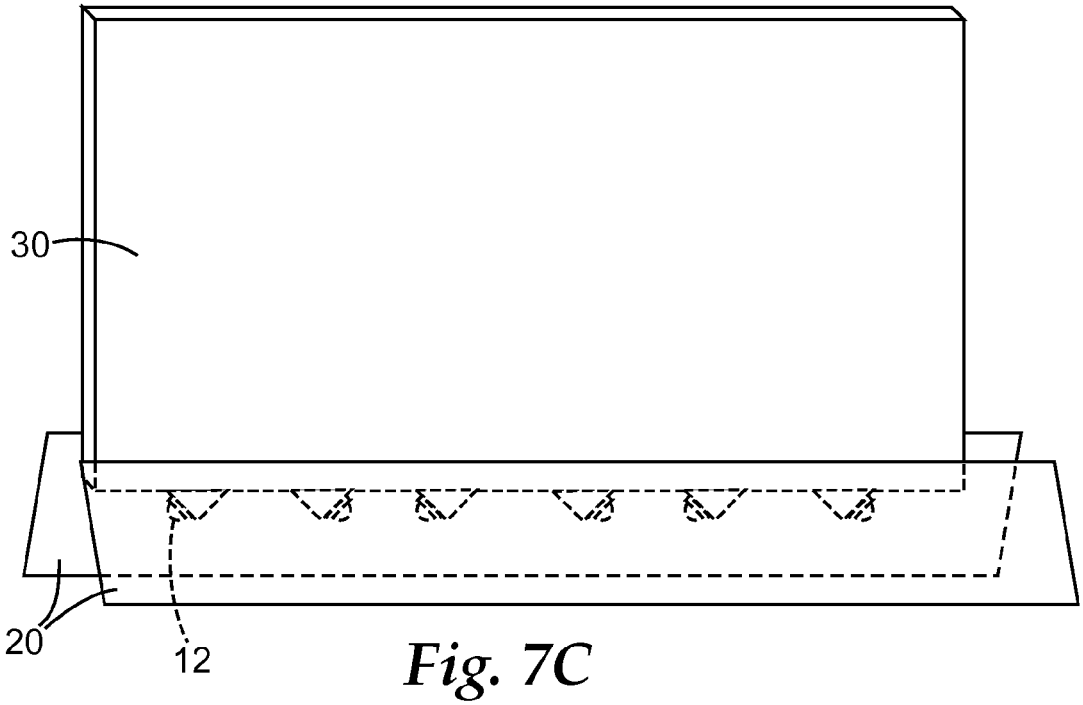

FIG. 7A is a schematic drawing showing multiple LEDs attached to the bottom of a cooling fin. FIG. 7B is a schematic drawing showing multiple LEDs attached to the side of a cooling fin. FIG. 7C is a schematic drawing showing multiple tilted LEDs and an optical system in the form of a wedge positioned parallel to a cooling fin.

Figure 8:
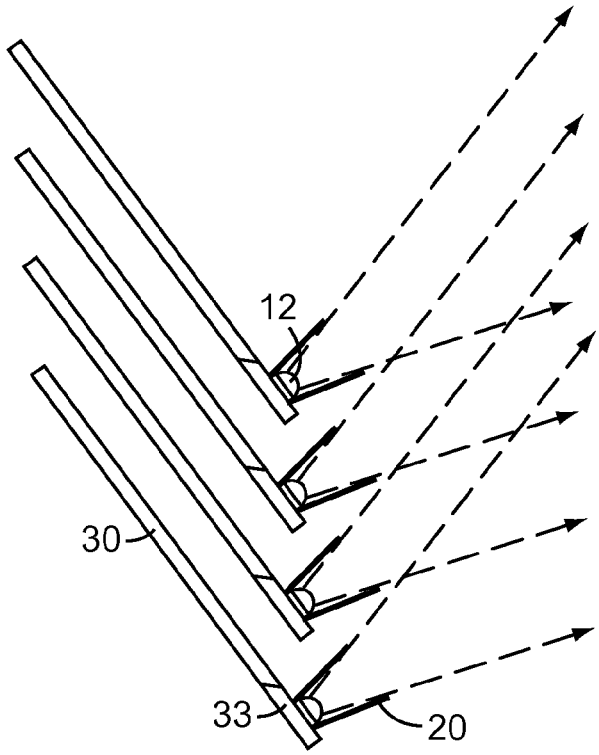

FIG. 8 is a schematic drawing of multiple cooling fins 30 tilted so that light emitted by the LEDs is directed in a desired pattern.

Figure 9:
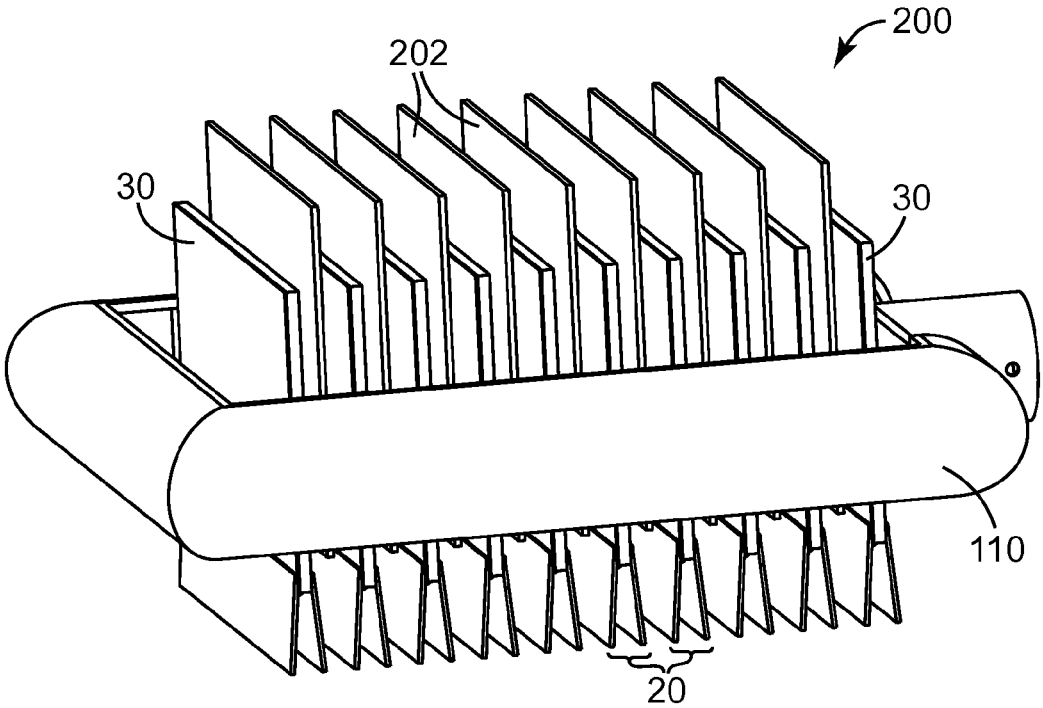

FIG. 9 is a perspective schematic view of a lighting system including one or more radiation plates positioned between adjacent cooling fins.

Figure 10:
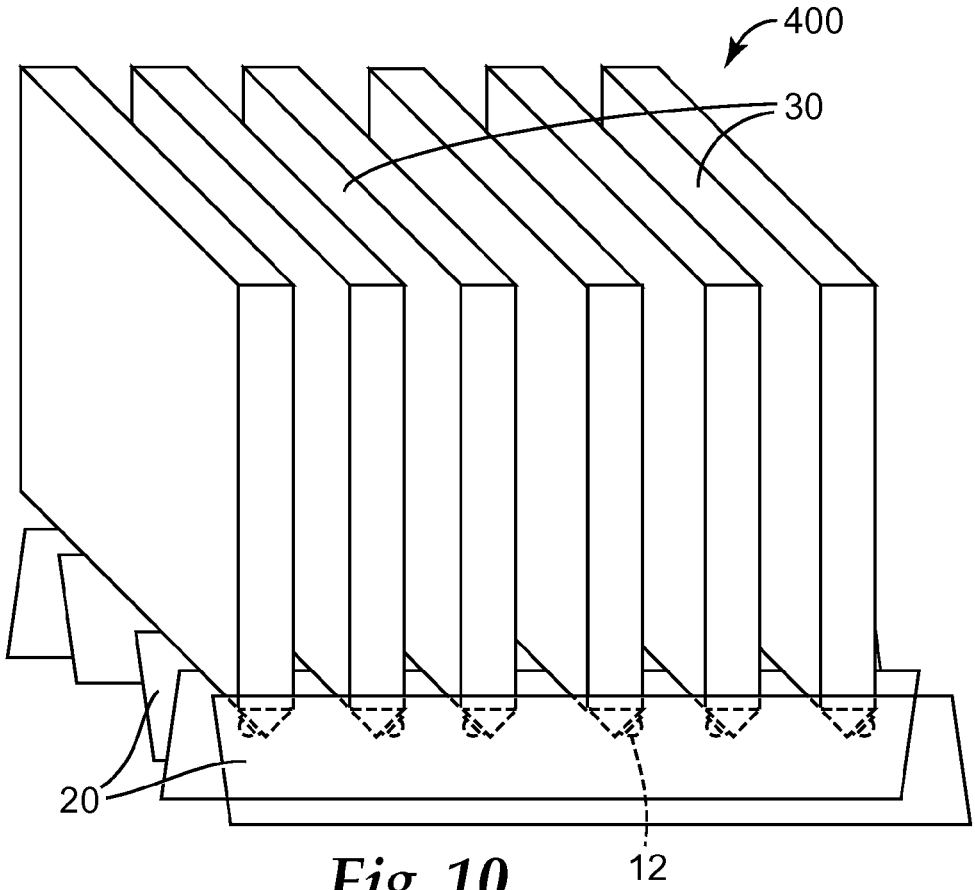

FIG. 10 is a schematic drawing showing multiple tilted LEDs 12 and a hollow wedge as the optical system 20 that is positioned perpendicular to cooling fin 30.

FIGS. 11-14 are various embodiments of a lighting system of the type described herein.

Figure 11:
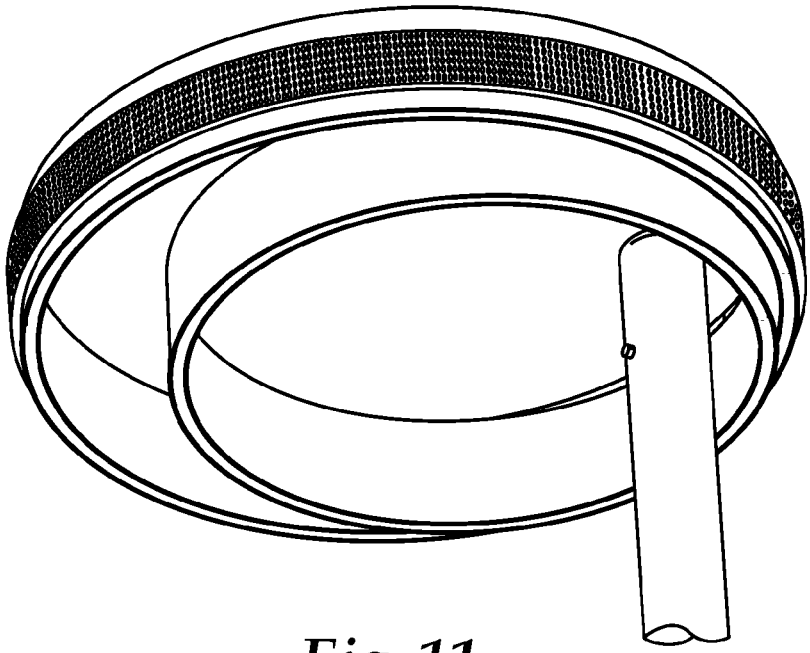
Figure 12:
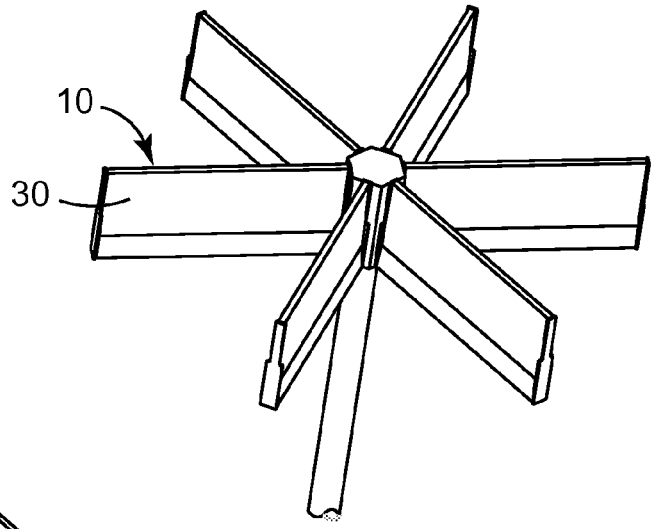
Figure 13:
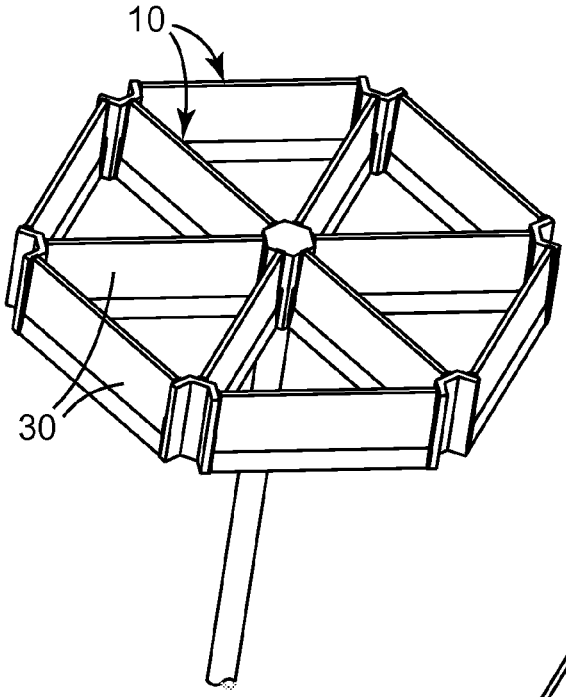
Figure 14:
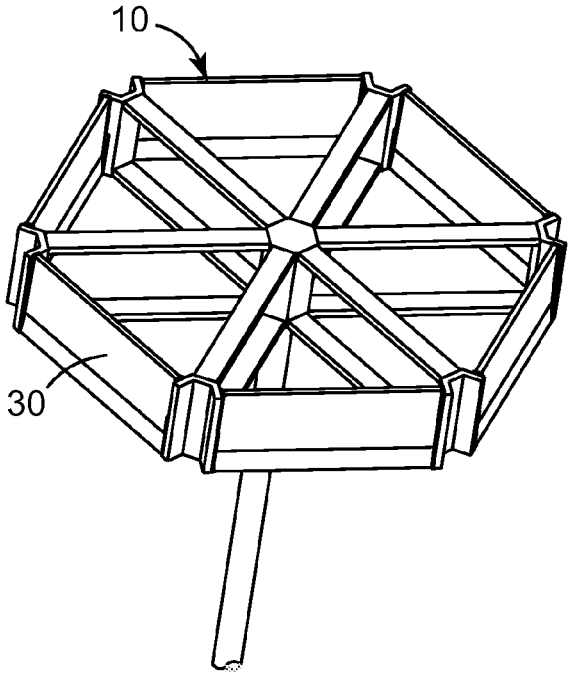
Figure 15:
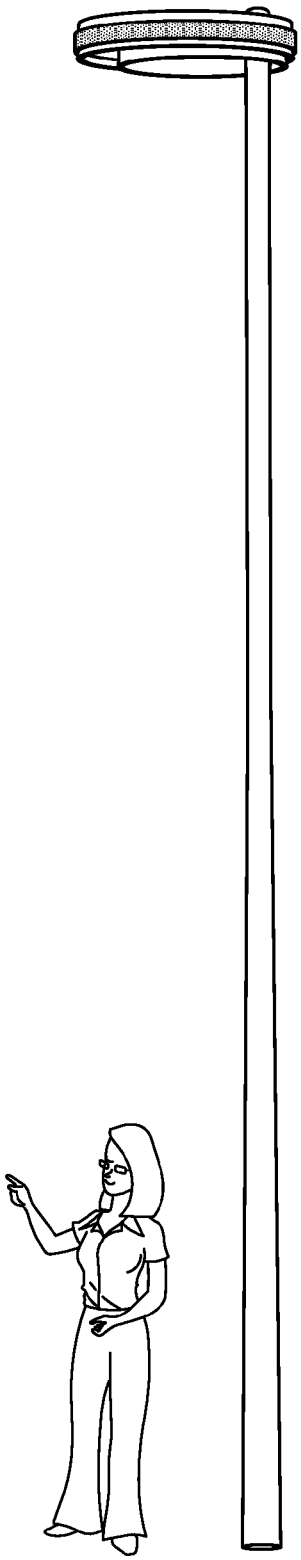

FIG. 15 is a street light including the lighting system of FIG. 11.

Figure 16:
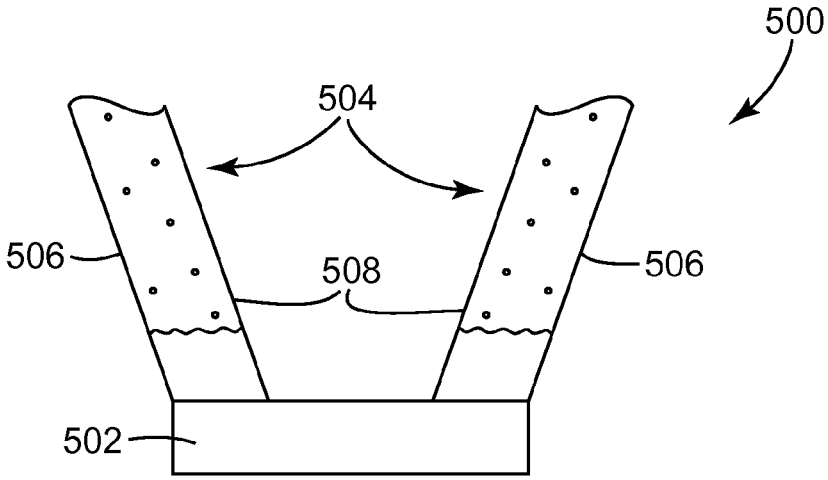
Figure 17:
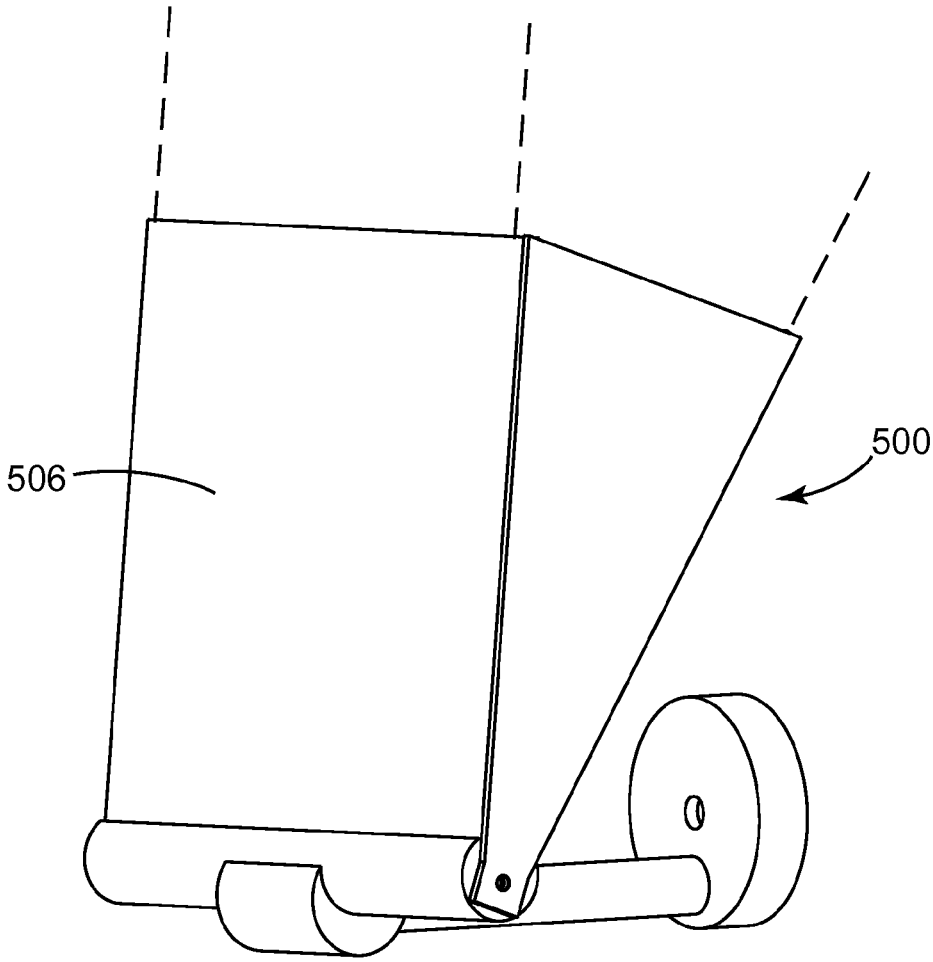

FIGS. 16 and 17 are schematic views of a wall wash light fixture including a lighting system of the type described herein.

Figure 18:
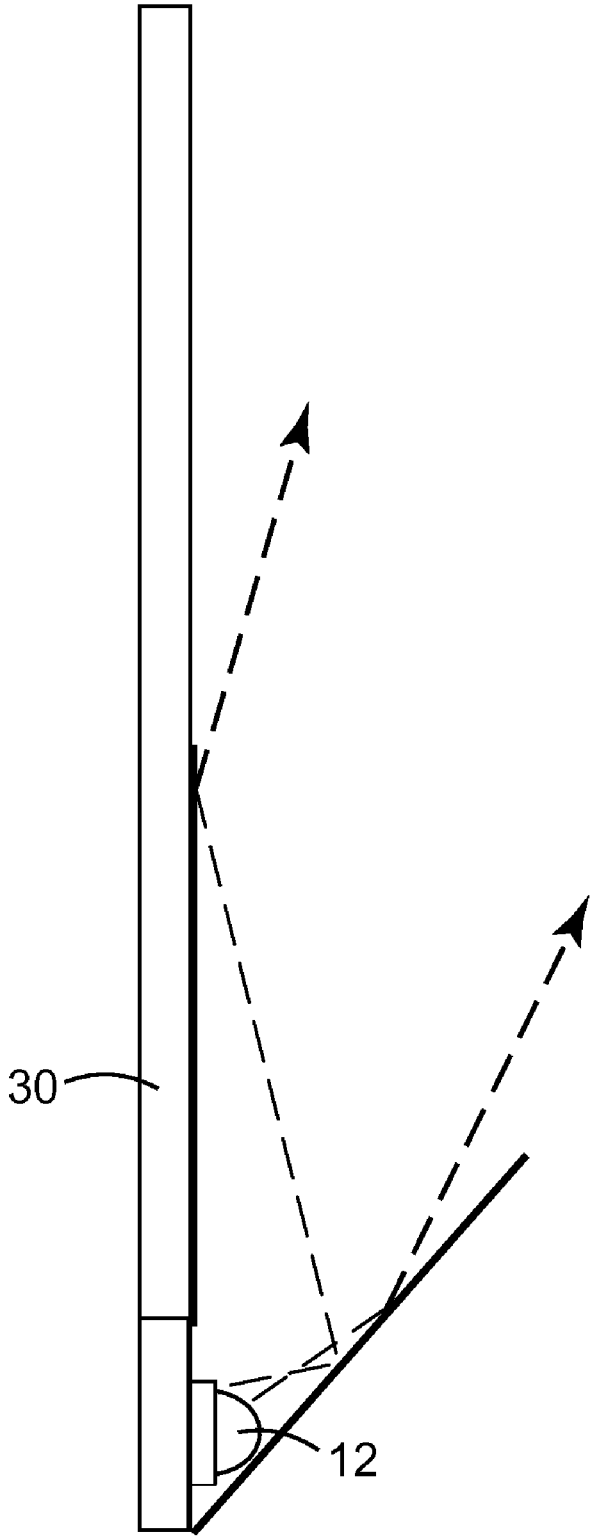

FIG. 18 is a schematic drawing depicting a lighting assembly that could inject light into a solid or hollow light guide for use in a backlight.

DETAILED DESCRIPTION

FIGS. 4A and 4B are cross-sectional schematic drawings of a lighting assembly 10 including an LED 12 that emits light 14. LED 12 is shown in an exemplary rectangular arrangement in FIGS. 4A and 4B, but other known configurations and shapes are also known and can be used in the lighting systems and assemblies of the present application. Electrical contacts to the LED are not shown for simplicity.

Any suitable material or materials may be used to form LED 12, e.g., metal, polymer, organic semiconducting materials, inorganic semiconducting materials, etc. As used herein, the terms "LED" and "light emitting diode" refer generally to light emitting semiconductor elements with contact areas for providing power to the diode. Different forms of inorganic LEDs may be formed, for example, from a combination of one or more Group III elements, one or more Group V elements (III-V semiconductor), one or more Group II elements, and one or more Group VI elements. Examples of III-V LED materials that can be used in an LED include nitrides, such as gallium nitride or indium gallium nitride, and phosphides, such as indium gallium phosphide. Other types of III-V materials can also be used, as can inorganic materials from other groups of the periodic table. Examples of II-VI LED materials include those listed in, for example, U.S. Pat. No. 7,402,831 (Miller et al.) or U.S. Patent Application Publication Nos. US2006-0124918 (Miller et al.) or US2006-0124938 (Miller et al.).

The LEDs may be in packaged or non-packaged form, including, for example, LED dies, surface-mounted LEDs, chip-on-board LEDs and LEDs of other configurations. Chip-on-board (COB) refers to LED dies (i.e., unpackaged LEDs) mounted directly onto a substrate. The term "LED" also includes LEDs packaged or associated with a phosphor where the phosphor converts light emitted from the LED to light at a different wavelength. Electrical connections to the LED can be made by, for example, wire bonding, tape automated bonding (TAB), or flip-chip bonding. The LEDs are schematically depicted in the illustrations, and can be, for example, unpackaged LED dies or packaged LEDs.

LEDs can be top emitting, such as those described in, for example, U.S. Pat. No. 5,998,925 (Shimizu et al.). Alternatively, LEDs can be side emitting, such as those described in, for example, U.S. Pat. No. 6,974,229 (West et al.). Exemplary commercially available LEDs for use with the lighting assemblies and systems of the present disclosure include, for example, Lambertian LEDs, including XLamp LEDs such as those sold by Cree; Luxeon® LEDS, such as those sold by Philips Lumileds; and side emitting or batwing distribution LEDs, including those sold by Philips Lumileds.

LEDs can be selected to emit at any desired wavelength, such as in the red, green, blue, ultraviolet, or infrared spectral regions. In an array of LEDs, the LEDs can each emit in the same spectral region, or can emit in different spectral regions. Different LEDs may be used to produce different colors where the color of light emitted from the light emitting element is selectable. Individual control of the different LEDs leads to the ability to control the color of the emitted light. In addition, if white light is desired, then a number of LEDs emitting light of different colors may be provided, whose combined effect is to emit light perceived by a viewer to be white. Another approach to producing white light is to use one or more LEDs that emit light at a relatively short wavelength and to convert the emitted light to white light using a phosphor wavelength converter. White light may be biased to the red (commonly referred to as warm white light) or to the blue (commonly referred to as cool white light).

Lighting assembly 10 can include more than one LED 12. Lighting assembly 10 also includes an optical system 20 that directs light 14 emitted by light emitting diode 12 and a cooling fin 30 including a two-phase cooling system. Optical system 20 and cooling fin 30 are positioned adjacent to and on opposite sides of LED 12 such that the two-phase cooling system removes heat generated by LED 12 and such that optical system 20 directs light 14 emitted by LED 12.

Optical system 20, as shown in FIGS. 4A and 4B, includes a wedge 22 having reflective internal surfaces 24 that direct the light 14 emitted by LED 12 in a desired pattern. Reflective internal surfaces 24 can be, for example, specularly or diffusely reflective, or some combination thereof. In some embodiments, reflective internal surfaces 24 may include a multi-layer polymer reflective film such as Vikuiti™ ESR film sold by 3M Company of Minnesota. External surfaces 26 and/or internal surfaces 24 of wedge 22 can be of any shape, including, for example, planar, curved, or corrugated. The side walls of wedge 22 are preferably formed of a rigid material. Exemplary rigid materials for use in wedge 22 can include, for example, plastic or metal capable of maintaining a desired shape such as, for example, aluminum or stainless steel. The material used to make wedge 22 can be the same as or different than the material used to make fin 30. As shown in FIGS. 4A and 4B, wedge 22 is parallel to cooling fin 30, but wedge 20 can also be positioned perpendicular to cooling fin 30. Wedge 20 can be solid (as is described, for example, in U.S. Patent Publication No. US 2009-001608 (Destain et al.)) or hollow. A solid wedge can have a planar or nonplanar exit surface in order to achieve a desired optical effect.

Optical system 20 may additionally or alternatively include any element that controls or directs light distribution including, for example, lenses (including, for example, moldable, UV-curable silicones used as lenses), diffusers, polarizers, baffles, filters, beam splitters, brightness enhancement films, reflectors (e.g., ESR), etc. alone or in combination to achieve the desired optical effects. For example, in one exemplary embodiment, the optical system includes the lens that is part of a commercially available LED, a solid or hollow wedge, and at least one or more reflectors.

Cooling fin 30, as shown in FIGS. 4A and 4B, includes a two-phase cooling system 32 that removes heat from and/or generated by LED 12. The two-phase cooling system includes a liquid 33 capable of boiling to form a gas or vapor 35. Two-phase cooling refers to the use of latent heat of phase change as a heat transfer mechanism. Two-phase cooling can be gravity driven—i.e., a low density gas rises and a heavy condensate drips down the walls. Two-phase cooling can also be driven, for example, by capillary action or by pump. A two-phase cooling system typically directly transmits heat, via hot vapor, to the cooling fin interior surface where it condenses—giving up its heat to the walls of the cooling fin—and running back down under the force of gravity to the pool of fluid. Heat is transferred as latent heat of evaporation which means that the fluid inside the system is continuously changing phase from fluid to vapor and back again. The liquid is evaporating at the hot end, thereby absorbing the heat from the LED package. At the cold end, the liquid is condensed, and the heat is dissipated to a heat sink (usually ambient air).

More specifically, in the lighting assembly shown in FIGS. 4A and 4B, LED 12 is in thermal contact with boiling surface 34. As LED 12 generates heat, the heat is diffused to boiling surface 34 which transfers heat to liquid 33, causing liquid 33 to form vapor 35. The heat is then carried upward by vapor 35 that rises and fills the space above liquid 33. Vapor 35 eventually condenses on interior surfaces 38 of cooling fin 30, giving up its heat to walls 36. The exterior surfaces 40 of heated walls 36 are then cooled by convection and radiation heat transfer from the exterior surfaces 40 of cooling fin 30. Boiling surface 34 is effectively held at the boiling temperature of liquid 33 (as a function of the pressure within cooling fin 30). The boiling surface can include one or more of various organic and inorganic coatings or surface modifications known to those skilled in the art to enhance nucleate boiling by aiding in nucleation and raising the boiling heat transfer coefficient.

The amount of liquid 33 within cooling fin 30 is selected so that at all times, some liquid 33 will remain within cooling fin 30. Exemplary fluids for use in the lighting assembly include, for example, water, glycol, brines, alcohols, chlorinated liquids, brominated liquids, perfluorocarbons, silicones, hydrocarbon alkanes, hydrocarbon alkenes, hydrocarbon aromatics, hydrofluorocarbons, hydrofluoroethers, fluoroketones, hydrofluoroolefins, and non-flammable segregated HFEs. One advantage of using water is that it is relatively inexpensive and widely available, but some disadvantages of water include that the use of water can necessitate more expensive, all copper construction of the fin and can make the fin more vulnerable to rupture upon freezing. Most alcohol and hydrocarbon compounds (e.g., alkanes, alkenes, aromatics, ketones, esters, etc.) that have sufficient volatility for use in two-phase applications are also quite flammable. Many chlorinated and brominated compounds (e.g., tricholoroethylene) are either highly regulated for their toxicity or they deplete the ozone layer (e.g., CFCs). Perfluorocarbon and commercially significant hydrofluorocarbon fluids have high global warming potentials. For these reasons, fluoroketones and hydrofluoroethers are two exemplary preferred working fluids. Exemplary preferred fluids for use in the lighting assembly have boiling points that are between about −40° C. and 100° C.

Some exemplary advantages of two-phase cooling include: (1) large heat fluxes can be dissipated due to the latent heat of evaporation and condensation; (2) reduced lighting assembly and/or system weight and volume; (3) smaller heat transfer area compared to alternatives; (4) passive circulation and the ability to dissipate high heat fluxes with minimal temperature differences between the boiling surface and coolant when implemented with surface enhancements; and (5) the ability to have a minimal temperature difference between the LED and the convective wall surface. Further, the present application relates to a lighting system or assembly in which the convective cooling surface is the same surface as the two-phase cooling surface.

In at least some embodiments, it is preferable to minimize the thermal path between the LED 12 and the boiling surface 34. The size of cooling fin 30 is determined by the area that is needed to dissipate the heat generated by LED 12. The side walls 36 of cooling fin 30 are preferably sufficiently thin to minimize thermal resistance from the inside condensing surfaces 38 and the outside convective cooling surfaces 40 and preferably sufficiently thick to withstand the internal and external pressure differential. Side walls 36 of cooling fin 30 can be formed of any material that meets these requirements such as, for example, steel, aluminum, copper, plastic, or stainless steel. Some preferred clear materials include, for example, glass and plastic.

As shown in FIGS. 4A and 4B, boiling surface 34 of cooling fin 30 is parallel to the LED mounting surface but the LED mounting surface may also be tilted. Side walls 36 of cooling fin 30 may be solid or flexible such that cooling fin 30 can have a variable volume or a fixed volume. Further, side surfaces 36 of cooling fin 30 may be of any desired shape, including, for example, planar, cylindrical, or conical. One additional advantage of using a hollow cooling fin is that it is relatively lightweight and facilitates creation of a relatively lightweight lighting assembly or lighting system. However, in an alternative embodiment, one or more cooling fins 30 can be solid. In some alternative embodiments, a lighting system includes multiple cooling fins 30, at least one of which is hollow and at least one of which is solid.

FIGS. 4A and 4B show LED 12 attached directly to cooling fin 30. LED 12 may also be attached to a substrate, including, for example, a thermally conductive substrate, that is attached to one or both of hollow wedge 20 or cooling fin 30. In one exemplary embodiment of this type of lighting assembly, the substrate has a first major surface that is adjacent to cooling fin 30 and a second major surface that is adjacent to optical system 20. LED 12 can be directly attached to either first or second major surface of the substrate. In another alternative embodiment, the substrate, for example, copper-clad polyimide, can be chemically etched or laser ablated such that the substrate does not add to the thermal resistance.

The lighting assemblies of the present disclosure include an LED that is designed to be attachable to a substrate using a number of suitable techniques, e.g., soldering, press-fitting, piercing, screwing, etc. One exemplary substrate is a thermally conductive substrate that conducts heat away from the LED. In some embodiments, the substrates can be electrically conductive, thereby providing a circuit pathway for the LED (see, for example, U.S. Patent Publication No. US20070216274 (Schultz et al.)). Further, in some embodiments, the lighting assembly includes a reflective layer proximate a major surface of the substrate to reflect at least a portion of light emitted by the LED. Further, some embodiments include an LED having a post that can provide a direct thermal connection to the substrate (see, for example, U.S. Pat. Nos. 7,285,802 (Ouderkirk et al.) and 7,296,916 (Ouderkirk et al.)). In an exemplary embodiment, this direct thermal connection can allow a portion of heat generated by the LED to be directed away from the LED and into the substrate in a direction substantially orthogonal to a major surface of the substrate, thereby reducing the amount of generated heat that is spread laterally away from the LED.

The thermally conductive substrate may include any suitable material or materials that are thermally conductive, e.g., copper, nickel, gold, aluminum, tin, lead, silver, indium, gallium, zinc oxide, beryllium oxide, aluminum oxide, sapphire, diamond, aluminum nitride, silicon carbide, pyrolite, graphite, magnesium, tungsten, molybdenum, silicon, polymeric binders, inorganic binders, glass binders, polymers loaded with thermally conductive particles that may or may not be electrically conductive, and combinations thereof. In some embodiments, the substrate can be attached to another material or materials, e.g., ultrasonically or otherwise weldable to aluminum, copper, metal coated ceramic or polymer, or thermally conductive filled polymer. The substrate can be of any suitable size and shape. In some embodiments, the substrate may be electrically conductive. Such an electrically conductive substrate may include any suitable electrically conductive material or materials, e.g., copper, nickel, gold, aluminum, tin, lead, silver, indium, gallium, and combinations thereof. The substrate may serve a combination of purposes, including, for example, making an electrical connection to LED 12, providing a direct thermal pathway away from LED 12, providing heat spreading laterally away from the LED 12, and/or providing electrical connections to other systems.

FIGS. 5 and 6 are, respectively, a side view and a perspective view of a lighting system 100 that includes multiple individual lighting assemblies 10. Any suitable number of LEDs 12 and/or lighting assemblies 10 can be included in lighting system 100. As shown in FIGS. 5 and 6, lighting system 100 includes multiple cooling fins 30 at least some of which include a two-phase cooling system 32 and each of which is positioned adjacent to LEDs 12. FIGS. 5 and 6 also show a housing 110 that houses at least a portion of a lighting assembly 10, such as, for example, LED 12, optical system 20, and/or cooling fin 30.

The distance between adjacent fins 30 is selected in accordance with the conventional convection theory to maximize heat transfer between the lighting assembly and the surrounding environment. The fins are preferably a sufficient distance apart to permit enough air to flow past the fins and remove the heat. For example, in one exemplary embodiment the spacing is between about 1 mm and about 100 mm. In one exemplary embodiment, the spacing is about 25 mm. This spacing promotes effective convective cooling, which benefits from complete access for air flow from the bottom to the top of cooling fins 30. Cooling fins 30 preferably have an area that provides sufficient cooling and a fin spacing that facilitates convective air flow.

Lighting system 100 also includes multiple hollow wedges each of which directs the light emitted by LEDs 12 and each of which is positioned adjacent to LEDs 12. The distance between adjacent optical systems 20 is selected in accordance with the conventional convection theory to maximize and/or optimize heat transfer between the lighting assembly and the surrounding environment. The optical systems are preferably a sufficient distance apart to permit enough air to flow past the fins and remove the heat. This spacing promotes effective cooling, which benefits from complete access for air flow from the bottom of optical system 20 to the top of cooling fins 30. Optical system 20 preferably has a shape and size that provide for sufficient cooling and fin spacing that facilitates convective air flow.

LEDs can be positioned at or adjacent to the bottom of cooling fin 30. FIG. 7A is a schematic drawing showing multiple LEDs 12 attached to the bottom of cooling fin 30. LEDs 12 are pointing straight down in FIG. 7A. FIG. 7B is a schematic drawing showing multiple LEDs 12 attached to the side of cooling fin 30.

LEDs 12 can also be tilted to point in a direction that gives a desired optical distribution (e.g., LEDs can be, for example, tilted in a direction parallel to cooling fin 30 or perpendicular to cooling fin 30). Optical system 20 adjacent to LEDs 12 can be, for example, parallel or perpendicular to cooling fin 30. FIG. 7C is a schematic drawing showing exemplary tilted LEDs 12 and an optical system in the form of a wedge positioned parallel to cooling fin 30. FIG. 10 is a schematic drawing showing multiple tilted LEDs 12 and a hollow wedge as the optical system 20 that is positioned perpendicular to cooling fin 30. Advantages of using the perpendicular wedge configuration of FIG. 10 include minimizing the overall size of the lighting system by allowing the cooling fin separation to be selected based solely or largely on convective cooling, rather than being limited by the optics. Additionally, the tilted diode configuration shown in FIG. 10 has manufacturing advantages because all of the LEDs 12 on an individual module are tilted in the same direction. Those of skill in the art will appreciate that other combinations of LED tilt angles, choice of optical elements, and orientations of optical elements are included in the present disclosure and can be advantageous in achieving a desired light distribution.

In another configuration, multiple cooling fins 30 can be tilted back such that light emitted by LEDs 12 is directed out or up, as is shown schematically in FIG. 8. Cooling fins 30 are substantially in an upright position such that the two phase cooling liquid within each cooling fin 30 covers the LED 12 attachment location and such that convective cooling carries heat away from the condensing surfaces of cooling fin 30. Further, multiple cooling fins 30 or lighting assemblies 10 can be combined into a stacked system, maintaining the function while multiplying the light output.

FIG. 9 is a perspective schematic view of a lighting system 200 including one or more radiation plates 202 positioned between adjacent cooling fins 30. Radiation plates 202 assist in maintaining or increasing radiative cooling. Because radiation plates 202 are not attached to an LED 12, they are cooler than cooling fins 30. Consequently, radiation plates 202 are able to absorb more thermal radiation from nearby cooling fins 30 than they emit. Spacing between cooling fins 30 and radiation plates 202 is dictated by the same convective cooling calculation as cooling fins alone. However, because radiation plates 202 do not have LEDs or optical systems mounted to them, they can be thinner and are less expensive than cooling fins. By increasing the total convective and radiative surface area of the lighting system, they can remove additional heat from the LEDs.

FIGS. 11-14 are various exemplary embodiments of a lighting system of the type described herein.

The lighting assembly and/or lighting system described herein can be used in various devices, including, for example, street light, a backlight (including, for example, a sun-coupled backlight), a wall wash light, a billboard light, a parking ramp light, a high bay light, a parking lot light, a signage lit sign (also referred to as an electric sign), static signage (including, for example, sun-coupled static signage), illuminated signage, and other lighting applications. For purposes of illustration, FIG. 15 is a street light including the lighting system of FIG. 11.

FIGS. 16-17 are schematic views of a high power wall wash light fixture including a lighting system of the type described herein. As shown in FIG. 16, an exemplary wall wash light fixture 500 includes an LED 502, an optical system, and a two-phase cooling system. In the embodiment shown in FIGS. 16 and 17, the two-phase cooling system is part of the optical system. Specifically, LED 502 is positioned adjacent to two fins 504 that each include a two-phase cooling system as described above. Each fin includes an external surface 506 and a optically active surface 508. Optically active surface 508 of fin 504 acts as at least a portion of the optical system (those of skill in the art will appreciate that the optical system may also include, for example, lenses, diffusers, or reflectors on the LED in addition to optically active surfaces 508). Optically active surfaces 508 can, for example, be covered with, for example, ESR to form a light guiding cavity that distributes light in a desired distribution.

Exemplary applications for wall wash light fixtures include, for example, up-lighting large architectural surfaces (e.g., building exteriors) or other surfaces (e.g., billboards).

FIG. 18 is a schematic drawing depicting a lighting assembly that could inject light into a solid or hollow light guide for use in a backlight (e.g., in a LCD TV, in a sign, or in a display).

The following examples describe some exemplary constructions of various embodiments of the lighting assemblies and systems described in the present disclosure. The following examples also report some of the performance results of the lighting assemblies and systems.

EXAMPLE 1

A lighting assembly of the type shown generally in FIGS. 4A and 4B was formed. The cooling fin in the lighting assembly was aluminum (6061 aluminum) and had a hollow rectangular chamber (outside dimensions of 250 mm×150 mm×7 mm and wall thickness of 1 mm). The outside of the cooling fin was painted with high emissivity Ultra Flat Black paint (RUST-OLEUM) to enhance radiative heat transfer.

Six LEDs (Cree XREWHT-L1-000-00D01) were attached in a line in series to a flex circuit (0.001" thick polyimide film with copper traces) by soldering. Each of the six LEDs were thermally and mechanically attached to copper trace pads with thermally conductive epoxy (3M™ Thermally Conductive Epoxy Adhesive TC-2810) and electrically connected to the copper trace pads using solder. The flex circuit was in turn attached to the cooling fin along the 7 mm by 250 mm edge with the same thermally conductive epoxy. An LED driver (LEDDYNAMICs, 3021-D-E-1000) supplied power to the lighting assembly via wires attached to the two ends of the flex circuit.

The optical system was a hollow light guide formed from two aluminum sheets, 49.5 mm×250 mm×2 mm which enclosed the six LEDs. The aluminum sheets were attached to the cooling fin with Double Coated Tape 400 High Tack #415 sold by 3M Company. The hollow light guide had a trapezoidal cross section, with a 7 mm base width, 14 mm top width and height of 38 mm. Highly reflective film (Enhanced Specular Reflector ESR sold by 3M Company) was applied to the inside surface of the aluminum sheets with pressure sensitive adhesive structured for air release. This created a hollow light guiding cavity that directed light emitted by the six LEDs.

To a small hole near the top of the cooling fin was added approximately 15 cc of fluid (3M™ Novec™ Engineered Fluid HFE-7100 sold by 3M Company having a fluid density of 1.5 gm/cc). This volume of fluid was chosen to completely cover the bottom (boiling surface) of the cooling fin adjacent to the six LEDs. This amount of fluid included approximately 50% excess to allow for loss during the degassing procedure. The fluid was degassed by heating it to the boiling point (61° C.), by operating the LEDs with a current flow of 1 A. Heating the system by running the LEDs also forced the air to evacuate the hollow chamber of the cooling fin. The small hole was sealed with aluminum foil tape #425 sold by 3M Company. When sealed and cooled, the partially filled chamber was under vacuum. The resulting fluid volume of 6.6 cc was calculated using the fluid weight in the cooling fin and the fluid density.

The surface temperature of the cooling fin was measured near the top and bottom over a range of heat loads between 4.5 W and 14 W where "heat load" is defined as the difference between the total electrical power applied and the optical power output. The temperature difference between top and bottom ranged from 0.8° C. to 1.7° C. The temperature difference on a similarly sized solid aluminum plate of 2 mm thickness was modeled for comparative purposes. The results are shown in the Table I provided below.

TABLE I

Surface Temperature of the Cooling Fin

| Heat Load (W) | Measured Cooling Fin $T_{bottom} - T_{top}$ (° C.) | Estimated 7 mm Solid Al Fin $T_{bottom} - T_{top}$ (° C.) | Estimated 2 mm Solid Al Fin $T_{bottom} - T_{top}$ (° C.) |
|---|---|---|---|
| 4.5 | 0.8 | 2.0 | 6.8 |
| 10.1 | 1.3 | 4.4 | 15.4 |
| 14.0 | 1.7 | 6.1 | 21.4 |

Table I shows that the cooling fin of the lighting assembly of Example 1 had a much lower temperature range from top to bottom then the comparative solid plate.

Next, the efficacy of the lighting assembly of Example 1 was calculated by measuring the total light output divided by the input electrical power. The lighting assembly was placed inside a 1 m diameter integrating sphere to measure total light output while simultaneously monitoring input electrical power and LED temperature. The measurement system consisted of an OL-770 Multichannel Spectroradiometer (Optronic Laboratories), connected to an OL-IS-3900 1 Meter Integrating Sphere sold by Optronic Laboratories. The system was calibrated with a Standard of Total Spectral Flux and Total Luminous Flux, model OL 245-TSF, S/N L-909 sold by Optronics Laboratories and is traceable to NIST. Data was collected for operating currents of 350 mA, 700 mA, 900 mA and 1 A. Table II shows LED power (Watts), the measured light output (TLF) (lumens), LED temperature (° C.) and efficacy (lumen/Watt) for each specified current.

TABLE II

Efficacy Data for the Lighting Assembly of Example 1.

| LED Current (mA) | LED Power (W) | Light Output (lm) | LED Temp. (° C.) | Efficacy (lm/W) |
|---|---|---|---|---|
| 350 | 1.05 | 567 | 35.6 | 90.0 |
| 700 | 2.22 | 931 | 48.3 | 70.0 |
| 900 | 2.91 | 1075 | 56.6 | 61.5 |
| 1000 | 3.25 | 1132 | 60.1 | 58.0 |

Table II shows the high efficacy (lumen/Watt) for each specified current.

EXAMPLE 2

A lighting system was made from ten lighting assemblies of the type described in Example 1. To verify that the performance of each individual lighting assembly in the lighting system was substantially similar to that of the single lighting assembly described in Example I, the light output for each individual lighting assembly was measured along with the amount of fluid remaining inside the lighting assembly after degassing at three different current levels, as is shown in Table III.

TABLE III

Single Cooling fin vs. Multiple Cooling fin Performance Data.

| Module No. | Fluid Volume (cc) | Light Output at 350 mA (lm) | Light Output at 700 mA (lm) | Light Output at 1000 mA (lm) |
|---|---|---|---|---|
| 1 | 6.5 | 595.9 | 1058.2 | 1255 |
| 2 | 10.4 | 547 | 933 | 1177 |
| 3 | 11.1 | 557.1 | 951.9 | 1200 |
| 4 | 9.5 | 538.1 | 924.2 | 1183 |
| 5 | 10.7 | 538.8 | 921.8 | 1190 |
| 6 | 10.2 | 541.4 | 929.7 | 1185 |
| 7 | 12.0 | 561.9 | 959.3 | 1233 |
| 8 | 12.1 | 545.1 | 922.6 | 1180 |
| 9 | 12.8 | 556.7 | 979.9 | 1270 |
| 10 | 13.4 | 544.6 | 933.6 | 1176 |

Table III shows the consistency of performance of each individual lighting assembly. Table III also shows that all ten individual lighting assemblies were performing as expected when compared with the lighting assembly described in Example I. The results also show that the performance of each lighting assembly is substantially similar for a fluid volume range of 6.5 cc-13.4 cc at all three specified levels of LED current.

A square frame structure was made to hold the ten lighting assemblies as follows. Aluminum tubing sections were machined and welded together in a u-shape with slots along the inner edges of the sides of the u-shape to hold the ten lighting assemblies. The u-shape was welded to a 290 mm×65 mm×6.4 mm plate creating a closed rectangular structure. A 75 mm section of 61 mm OD aluminum tubing was welded to the plate to mount the fixture when assembled. A decorative plastic trim was added to the sides of the fixture to protect and guide the wires from each of the ten lighting assemblies to a wiring box next to the mounting tube. The ten lighting assemblies were mounted at a pitch (center-to-center) of 32 mm in the frame structure.

The assembled lighting system was measured to quantify the efficacy of the system. The assembled unit was placed in a 2 m integrating sphere OL-IS-7600 2 Meter Integrating Sphere (Optronic Laboratories) connected to a spectroradiometer OL-770 Multichannel Spectroradiometer (Optronic Laboratories) and the total light output was measured according to the manufacturer's recommendations. The resulting data is shown in Table IV.

TABLE IV

Efficacy of Lighting System of Example 2.

| LED Current (mA) | LED Power (W) | Light Output (lm) | LED Temp. (° C.) | Efficacy (lm/W) |
|---|---|---|---|---|
| 350 | 63.4 | 5490 | 35.8 | 86.6 |
| 500 | 93.3 | 7186 | 41.9 | 77.0 |
| 700 | 136.5 | 9028 | 49.3 | 66.1 |
| 1000 | 194.7 | 10919 | 62.8 | 56.1 |

Table IV shows high efficacy for the lighting system at each specified current, similar to Table II. Radiation heat transfer from the lighting system was limited by the parallel plate configuration of the 10 lighting assemblies. The spacing between adjacent lighting assemblies was greater than the minimum distance for optimum natural convection because the optics were larger than the cooling fin thickness.

EXAMPLE 3

Radiation plates (237 mm×170 mm×3 mm aluminum painted with Ultra Flat Black paint (RUST-OLEUM)) were placed between adjacent lighting assemblies of the lighting system of Example 2. The radiation plates were positioned to avoid significantly reducing the convection heat transfer from each lighting assembly. The purpose of these radiation plates was to absorb radiated heat from the lighting assemblies and convey heat to the surroundings via natural convection. The radiation plates were approximately 25.4 mm taller than the cooling fins, which theoretically should have increased radiation heat transfer from the lighting system. The paint on the cooling fins should have theoretically increased the emissivity of the cooling fin surface.

The effect of the radiation plates was measured by running thermal experiments with the assembled lighting system. The experiment was performed at an LED drive current of I=0.5 A. Once steady state temperature was achieved, the radiation plates were removed and the system was monitored until steady state was reached. Thermocouples were used to monitor the temperature of light assemblies 1, 3, and 9. The thermocouples were attached to the substrate of one LED on each of the lighting assemblies. Temperature at a steady state for the three lighting assemblies, with and without radiation plates, is shown in Table V.

TABLE V

Lighting Assembly Temperature at Steady State.

| | Assembly #1 (° C.) | Assembly #3 (° C.) | Assembly #9 (° C.) |
|---|---|---|---|
| With Radiation Plates | 40.0 | 37.0 | 41.5 |
| Without Radiation Plates | 40.6 | 38.7 | 42.2 |

Table V shows the lower operating temperature observed with the radiation plates and demonstrates the advantage of using radiation plates.

Advantages of the lighting systems and assemblies of the present application include, for example, low maintenance, energy efficiency, low lifetime cost, up to 20% improved efficiency over competing lighting systems, up to 50% fewer LEDs required to generate the same brightness, dynamic control dimming, and improved light color.

Illustrative embodiments of this disclosure are discussed and reference has been made to possible variations within the scope of this disclosure. These and other variations and modifications in the disclosure will be apparent to those skilled in the art without departing from the scope of the disclosure, and it should be understood that this disclosure is not limited to the illustrative embodiments set forth herein. Accordingly, the disclosure is to be limited only by the claims provided below.

What is claimed is:

1. A lighting assembly, comprising:

at least one light emitting diode that emits light;

an optical system that directs the light emitted by the at least one light emitting diode, the optical system positioned adjacent to the light emitting diode; and a cooling fin including a two-phase cooling system positioned adjacent to the at least one light emitting diode such that the two-phase cooling system removes heat from the light emitting diode, wherein the cooling fin is composed of a hollow material and the two-phase cooling system is contained within the hollow material of the cooling fin.

2. The lighting assembly of claim 1, wherein the assembly is used as at least one of a street light, a backlight, a wall wash light, a billboard light, a parking ramp light, a high bay light, a parking lot light, a signage lit sign, an electric sign, static signage, and illuminated signage.

3. The lighting assembly of claim 1, wherein the optical system includes a solid or hollow wedge.

4. The lighting assembly of claim 3, wherein the wedge is one of parallel or perpendicular to the cooling fin.

5. The lighting assembly of claim 3, wherein the wedge includes side surfaces that are at least one of planar, curved, or corrugated.

6. The lighting assembly of claim 1, wherein the optical system includes at least one of a lens, a diffuser, a polarizer, a baffle, a filter, a beam splitter, a brightness enhancement film, or a reflector.

7. The lighting assembly of claim 1, wherein the at least one light emitting diode is tilted.

8. The lighting assembly of claim 1, wherein portion of the cooling fin is tilted.

9. The lighting assembly of claim 1, wherein the cooling fin has one of a variable or fixed volume.

10. The lighting assembly of claim 1, wherein the cooling fin is one of planar, cylindrical, or conical.

11. The lighting assembly of claim 1, wherein the at least one light emitting diode is attached to one of a side surface of the optical system or a side surface of the cooling fin.

12. The lighting assembly of claim 1, wherein the at least one light emitting diode is attached to a substrate having a first major surface that is adjacent to the cooling fin and a second major surface that is adjacent to the optical system.

13. The lighting assembly of claim 1, wherein the two-phase cooling system and the optical system are part of a single device.

14. A lighting system, comprising:

multiple lighting assemblies of claim 1.

15. A lighting assembly, comprising:

multiple light emitting diodes that emit light;

an optical system that directs the light emitted by the light emitting diodes, the optical system positioned adjacent to the light emitting diodes; and multiple cooling fins each of which include a two-phase cooling system, the multiple cooling fins positioned adjacent to the light emitting diodes such that the two-phase cooling systems within the cooling fins remove heat from the light emitting diodes, wherein each of the cooling fins is composed of a hollow material and the two-phase cooling system is contained within the hollow material of each of the cooling fins.

16. The lighting assembly of claim 15, wherein each cooling fin is spaced from an adjacent cooling fin by between about 1 mm and about 100 mm.

17. The lighting assembly of claim 16, further including a radiation plate positioned between adjacent cooling fins.

18. The lighting assembly of claim 17, wherein the radiation plate is one of parallel or perpendicular to the cooling fins.

19. A lighting system, comprising:

multiple light emitting diodes that emit light;

an optical system that directs the light emitted by the light emitting diodes, the optical system positioned adjacent to the light emitting diodes;

multiple cooling fins comprising a first set of cooling fins each composed of a solid material and a second set of cooling fins each composed of a hollow material;

a two-phase cooling system within the hollow material of at least one of the second set of cooling fins; and a housing containing the multiple cooling fins, wherein the housing provides spacing between the cooling fins along an entire length of at least one convective cooling surface of each of the cooling fins.

20. A lighting assembly, comprising:

at least one light emitting diode that emits light;

an optical system that directs the light emitted by the at least one light emitting diode, the optical system positioned adjacent to the light emitting diode; and a cooling fin including a two-phase cooling system positioned adjacent to the at least one light emitting diode such that the two-phase cooling system removes heat from the light emitting diode, wherein the cooling fin is arranged in a round continuous configuration, wherein the cooling fin is composed of a hollow material and the two-phase cooling system is contained within the hollow material of the cooling fin.

21. A lighting assembly, comprising:

at least one light emitting diode that emits light;

an optical system that directs the light emitted by the at least one light emitting diode, the optical system positioned adjacent to the light emitting diode; and multiple cooling fins including a two-phase cooling system positioned adjacent to the at least one light emitting diode such that the two-phase cooling system removes heat from the light emitting diode, wherein the multiple cooling fins are arranged in a radial configuration around center point, wherein each of the cooling fins is composed of a hollow material and the two-phase cooling system is contained within the hollow material of each of the cooling fins.

22. The lighting assembly of claim 21, wherein the multiple cooling fins each have a first end adjacent the center point and a second end opposite the center point, and the assembly further comprises at least one additional cooling fin arranged adjacent the second ends of two of the multiple of cooling fins.

* * * * *